US009833046B2

(12) United States Patent
Fildan et al.

(10) Patent No.: US 9,833,046 B2
(45) Date of Patent: Dec. 5, 2017

(54) THIN GARMENT CLOSURE

(71) Applicants: Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: Dubrosky & Tracy Patent Service Corp., Central (HK)

( * ) Notice: Subject to any disclaimer, the term of this patent is extended or adjusted under 35 U.S.C. 154(b) by 233 days.

(21) Appl. No.: 14/966,483

(22) Filed: Dec. 11, 2015

(65) Prior Publication Data

US 2016/0338452 A1 Nov. 24, 2016

Related U.S. Application Data

(60) Provisional application No. 62/165,851, filed on May 22, 2015.

(51) Int. Cl.
*A44B 11/25* (2006.01)
*A41F 1/00* (2006.01)

(52) U.S. Cl.
CPC ..... *A44B 11/2588* (2013.01); *A41F 1/006* (2013.01)

(58) Field of Classification Search
CPC .... A41F 1/006; A41F 1/04; A41F 1/08; A41F 15/002; A44B 11/2588; A44B 17/0041; Y10T 24/45675; Y10T 24/45696; Y10T 24/4578; Y10T 24/45864; A44F 15/002; A41C 3/02
USPC ..... 24/460, 615, 656, DIG. 43, DIG. 46, 24/DIG. 47, DIG. 49, DIG. 54
See application file for complete search history.

(56) References Cited

U.S. PATENT DOCUMENTS 796,414 A * 8/1905 Chayes ..... A41F 3/02 24/319
4,161,806 A * 7/1979 Hennisse ..... A41F 1/006 24/586.11
6,009,604 A 1/2000 Fildan

* cited by examiner

*Primary Examiner* — Jack W Lavinder
(74) *Attorney, Agent, or Firm* — Kintner IP, LLC; Mary Frances Ludwig

(57) ABSTRACT

A thin garment closure includes a male member with a bar having a ball on at least one end and a female member having a trough shaped complementary to the bar. The bar is positionable in the trough when the male and female members in a substantially transverse orientation, and when one member is rotated so that both members are substantially coplanar the closure is closed. The male and female members each have a flat surface which contacts the flat surface of the mating member when the closure is closed, enabling a thin and narrow closure. In an embodiment, the trough has sidewalls which guide the bar into position in the trough for improved manipulation of the closure. In another embodiment, a detent resists decoupling of the closure while allowing coupling over a range of insertion angles.

20 Claims, 7 Drawing Sheets

THIN GARMENT CLOSURE

CROSS REFERENCE TO RELATED APPLICATION

This application claims the filing benefit under 35 U.S.C. §119(e) of U.S. Provisional Application No. 62/165,851, filed 22 May 2015, which is hereby incorporated by reference in its entirety.

TECHNICAL FIELD

The present invention pertains generally to fasteners, and more particularly to a thin garment closure.

BACKGROUND OF THE INVENTION

U.S. Pat. No. 6,009,604 describes a brassiere front closure which is easily manipulated by inserting a bar of a male member into a trough of a female member when the members are oriented orthogonally, and rotating the members to a coplanar position to lock the closure. The improved closure disclosed herein includes novel features which permit easier alignment of the members for simplified manipulation. The novel structure enables an extremely thin closure for improved comfort and visual appearance. In addition, a single female closure member accepts various sizes of male closure member, enabling a garment system with readily detachable and interchangeable components.

BRIEF SUMMARY OF THE INVENTION

The present invention is directed to a thin garment closure for lingerie, brassieres, swimwear, and the like. The closure includes male and female members which couple by insertion of a bar of the male member into a trough of the female member with the members in a transverse orientation, followed by a rotation of one member to lock the members in a substantially coplanar orientation. The male and female members each have a flat surface which contacts the flat surface of the mating member when the closure is closed, enabling a thin and narrow closure.

In accordance with an embodiment of the closure, the male member has a male exterior side connected to a first end of a garment, a bar with a ball on at least one end, and a flat front surface between the male exterior side and the bar. The female member has a female exterior side connected to a second end of the garment, a trough shaped complementary to the bar, a flat rear surface at least partially surrounding the trough, and a detent means. The bar is positionable in the trough when the male member and the female member are in a substantially transverse orientation. When the bar is positioned in the trough and the male member is rotated so that the male member and the female member are substantially coplanar, the flat front surface of the male member contacts the flat rear surface of the female member and the first and second ends of the garment are connected.

In accordance with another embodiment, the bar of the male member has a ball on both ends.

In accordance with another embodiment, the trough of the female member is open on both ends.

In accordance with another embodiment, the trough has sidewalls with curved ends which guide the ball of the bar into position in the trough.

In accordance with another embodiment, the closure has a tensile strength of between about 20 pounds and about 30 pounds.

In accordance with another embodiment, the bar is positionable in the trough when the male member and the female member are oriented at an angle of between about 75 degrees and about 105 degrees.

Other embodiments, in addition to the embodiments enumerated above, will become apparent from the following detailed description, taken in conjunction with the accompanying drawings, which illustrate, by way of example, the principles of the garment closure and method of use.

LIST OF DRAWING REFERENCE NUMERALS

20 closure
- 30 male member
  - 32 bar
  - 33 ball
  - 34 flat front surface
  - 36 male exterior side
- 40 female member
  - 42 trough
  - 43 concave region
  - 44 flat rear surface
  - 46 female exterior side
  - 47 sidewall
  - 48 curved end
  - 49 female front surface
- 50 detent
- 60 flange
- 62 alignment bar
- 63 reinforcement bar
- 70 recesses

500 garment
- 510 first end
- 520 second end

600 primary garment piece
700 secondary garment piece

DETAILED DESCRIPTION OF THE INVENTION

Figure 1:
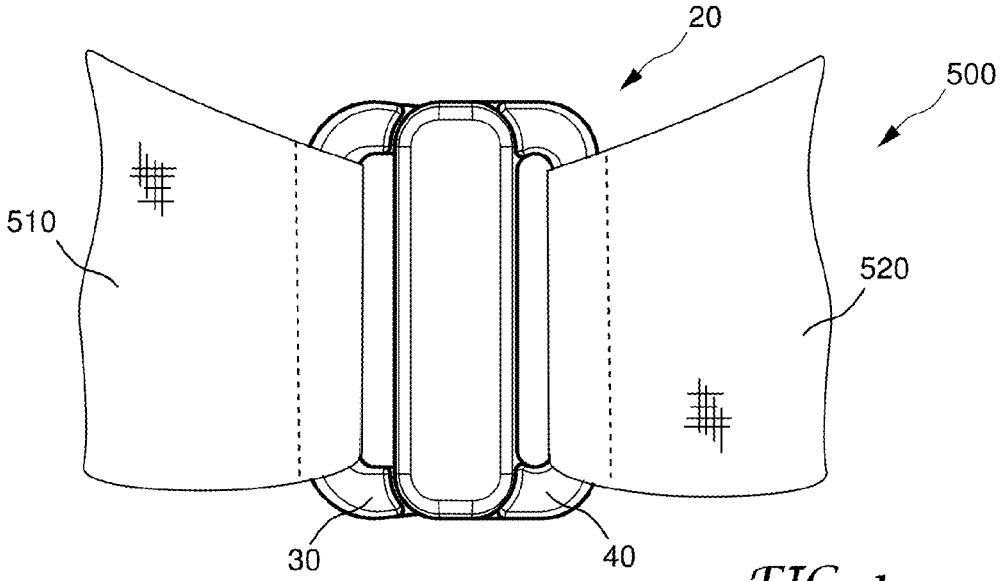
FIG. 1 is a reduced partial front elevation view of a thin garment closure connected to a garment.

Referring initially to FIG. 1, there is illustrated a reduced front elevation view of a thin garment closure 20 in a closed position and connected to a garment 500. Closure 20 includes a male member 30 and a female member 40 (see also FIGS. 4 & 10). Garment 500 has a first end 510 and a second end 520 which are connectable by means of closure 20. Closure 20 is particularly suited for use with garments such as brassieres, lingerie, and swimwear, however its utility is not limited to these applications. In an embodiment, the closure is a front closure for a brassiere, where first and second ends 510 and 520 of garment 500 are to be joined between two brassiere cups. In another embodiment, the closure is a brassiere shoulder strap fastener and first and second garment ends 510 and 520 include one end of a brassiere shoulder strap and one of either material above a brassiere cup or material at the top of a brassiere back strap. In another embodiment, the closure is a back closure for a brassiere, where first and second ends 510 and 520 of garment 500 are two ends of a back strap.

Figure 2:
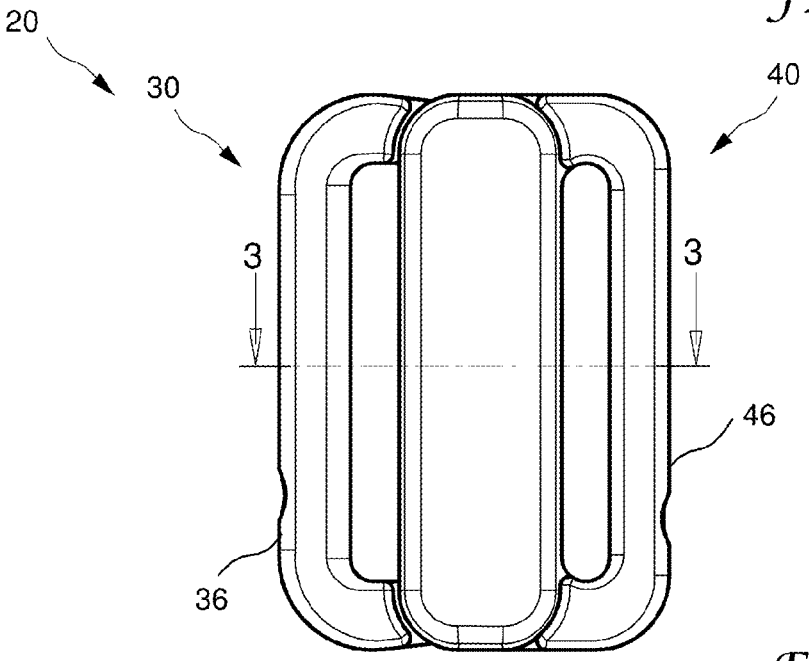
FIG. 2 is a front elevation view of the closure.
Figure 3:
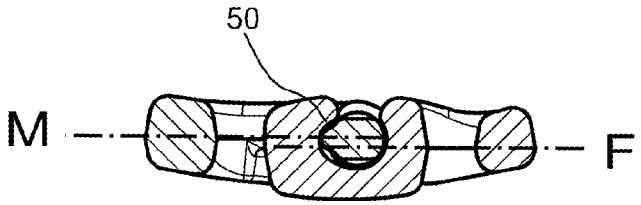
FIG. 3 is a cross-sectional view along the line 3-3 of FIG. 2.
Figure 5:
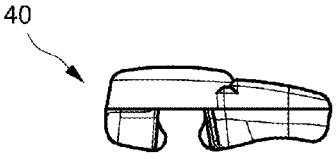
FIG. 5 is a bottom plan view of the female member.

FIG. 2 is a front elevation view of closure 20 and FIG. 3 is a cross-sectional view along the line 3-3 of FIG. 2. Male member 30 and female member 40 have, respectively, male and female exterior sides 36 and 46. First end 510 of garment 500 is connected to male exterior side 36 and second end 520 is connected to female exterior side 46 (see also FIG. 1). In the shown embodiment, ends 510 and 520 are connected, respectively, to exterior sides 36 and 46 of closure 20 by feeding the fabric of each garment end through a loop in the corresponding exterior side and stitching the fabric of the garment end to itself (as indicated by the dashed lines of FIG. 1). Ends 510 and 520 of garment 500 may be connected to exterior sides 36 and 46 of closure 20 by other methods well known in the art, including simply passing the end through the opening for attachment elsewhere on the garment, as in the case of an adjustable length brassiere shoulder strap.

Figure 4:
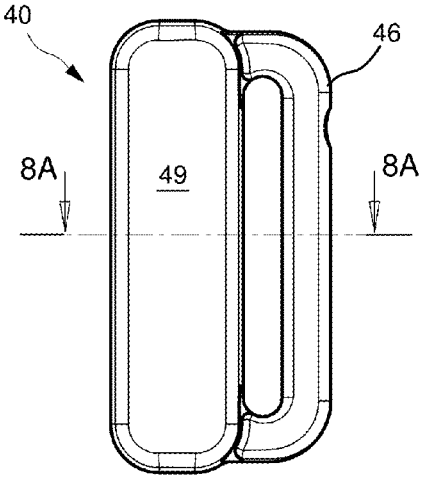
FIG. 4 is a front elevation view of a female member of the closure.
Figure 6:
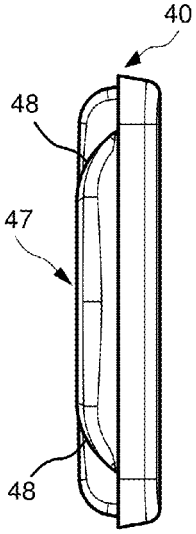
FIG. 6 is a left side elevation view of the female member.
Figure 7:
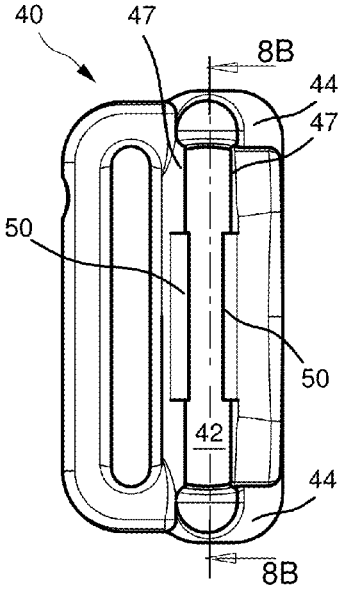
FIG. 7 is a rear elevation view of the female member.
Figure 8A:
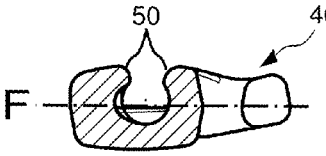
FIG. 8A is a cross-sectional view along the line 8A-8A of FIG. 4.
Figure 8B:
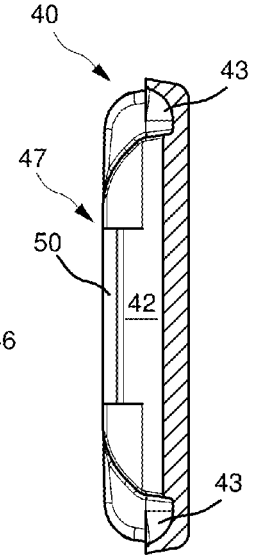
FIG. 8B is a cross-sectional view along the line 8B-8B of FIG. 7.

FIGS. 4-9 of female member 40 of closure 20 give, respectively, front elevation, bottom plan, left side elevation, rear elevation, cross-sections along lines 8A-8A of FIGS. 4 and 8B-8B of FIG. 7, and front and rear perspective views. Female member 40 is preferably unitarily formed by molding and comprised of a high performance polymer such as polyoxymethylene (POM) or polyamide (PA). The tensile strength of closure 20 when made in engineering plastics such as POM or PA is between about 20-30 lbs. Female member 40 generally lies in the plane F shown in FIG. 8A. When a garment including closure 20 is worn, the rear of female member 40 faces the body of the wearer. Female member 40 has a trough 42 in the rear face which is preferably oriented longitudinally and substantially parallel to and offset from female exterior side 46. Trough 42 is shaped complementary to a bar 32 of male member 30 (see discussion of FIGS. 10-13), so that trough 42 may receive bar 32 of male member 30. Female member 40 also has one or more flat rear surfaces 44 which adjoin and at least partially surround trough 42. Female member 40 has a female front surface 49 which may have various shapes such as rectangular or ovate, and may include various decorations or logos.

Figure 10:
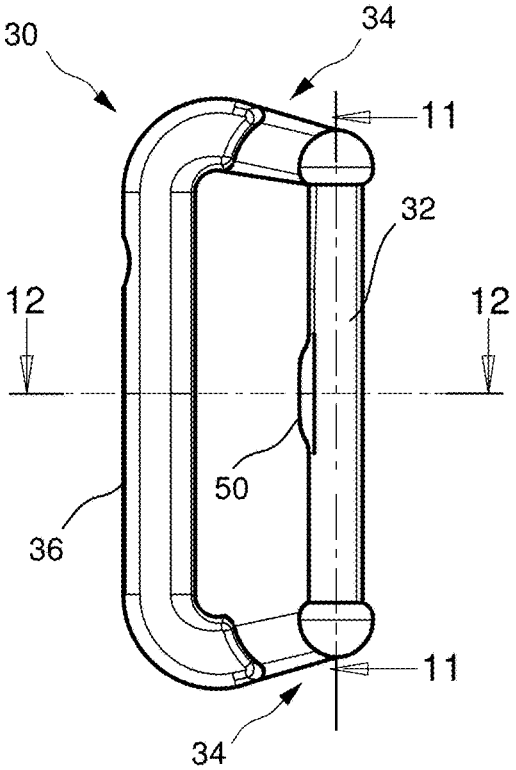
FIG. 10 is a front elevation view of a male member of the closure.
Figure 11:
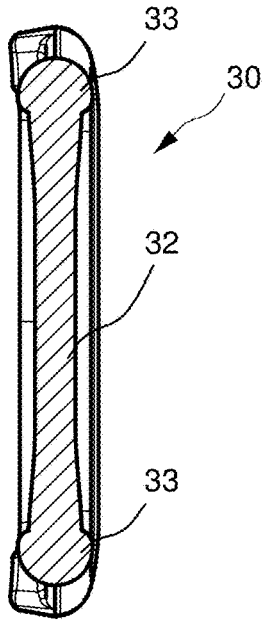
FIG. 11 is a cross-sectional view along the line 11-11 of FIG. 10.

FIGS. 10-13 of male member 30 of closure 20 give, respectively, front elevation, cross-sections along lines 11-11 and 12-12 of FIG. 10, and front perspective views. Male member 30 is preferably unitarily formed in the manner and of materials as described above for female member 40. Male member 30 generally lies in the plane M shown in FIG. 12. Male member 30 has a bar 32 which is preferably oriented longitudinally and substantially parallel to and offset from male exterior side 36. Bar 32 is shaped to be received in trough 42 of female member 40. In the shown embodiment, bar 32 has two ends and each end terminates in a ball 33. Ball as used herein means a rounded protuberance. The diameter of ball 33 is preferably greater than the thickness of bar 32, in other words the ends of bar 32 are enlarged. In another embodiment, bar 32 has a ball 33 at only one end. Each ball 33 corresponds to a complimentary shaped concave region 43 on the ends of female trough 42. The rear of male member 30 faces the body of the wearer when worn. Male member 30 has one or more flat front surfaces 34 located between male exterior side 36 and bar 32. Bar 32 of male member 30 may have various shapes including cylindrical, rectangular, polygonal, or of tapered width as shown in FIG. 11.

Figure 12:
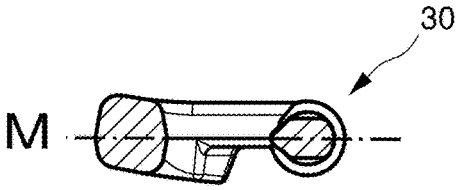
FIG. 12 is a cross-sectional view along the line 12-12 of FIG. 10.
Figure 13:
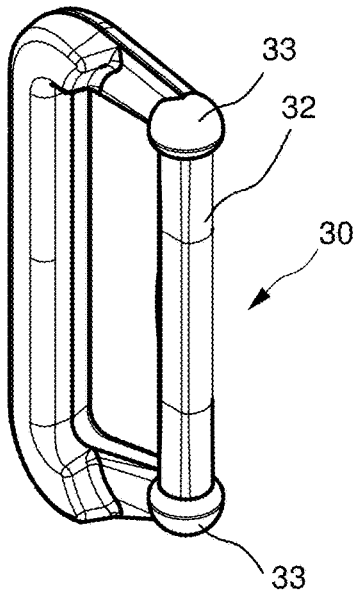
FIG. 13 is a front perspective view of the male member.
Figure 14A:
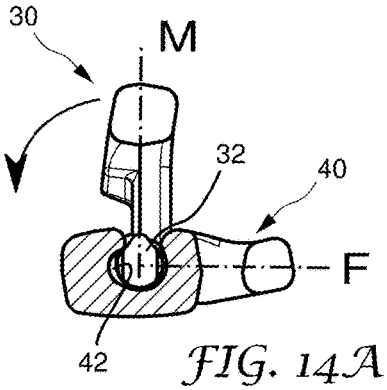
FIGS. 14A-B are cross-sectional views of the closure in partially closed positions.
Figure 14B:
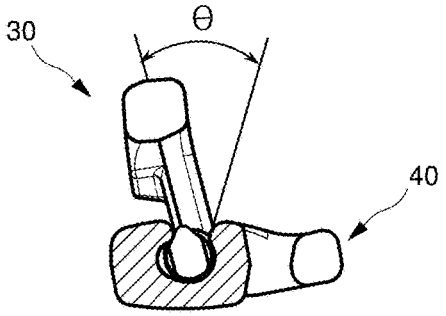
Figure 17A:
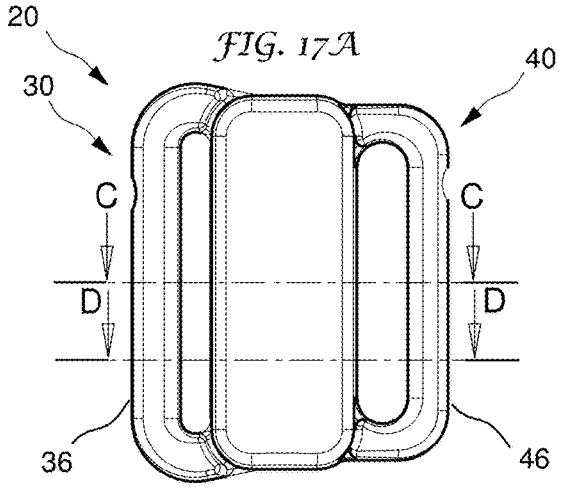
FIG. 17A is a reduced front elevation view of another embodiment of the closure.
Figure 17B:
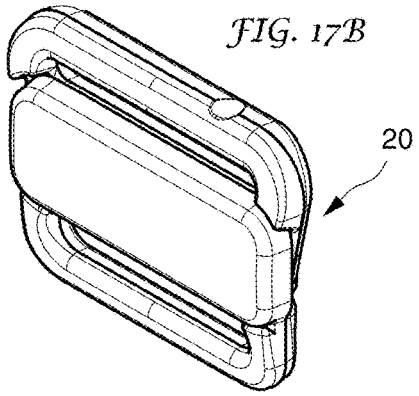
FIG. 17B is a reduced front perspective view thereof.
Figure 17C:
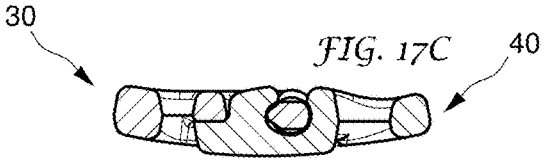
FIGS. 17C-D are cross-sectional views along the lines C-C and D-D of FIG. 17A.
Figure 17D:
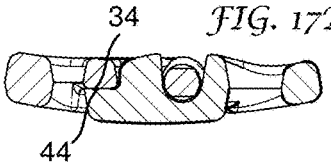
Figure 17H:
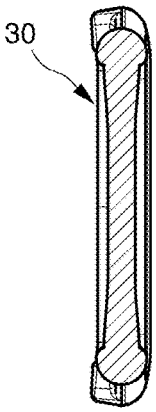
FIGS. 17G-H are, respectively, cross-sectional views along the lines G'-G' and H-H of FIG. 17E.
Figure 17E:
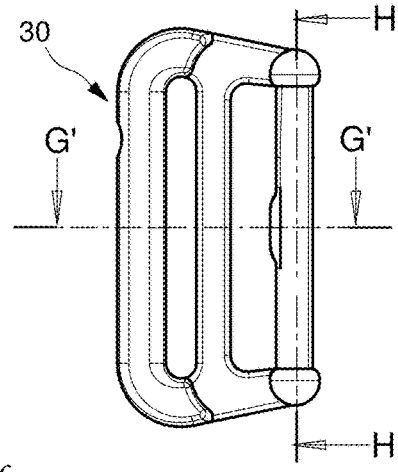
FIGS. 17E-F are reduced front elevation and perspective views, respectively, of the male member of the closure.
Figure 17F:
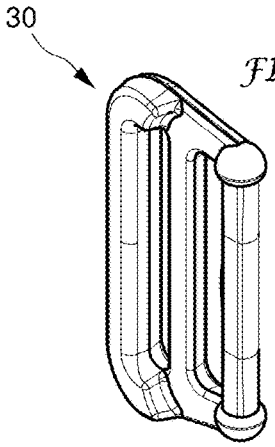
Figure 17G:
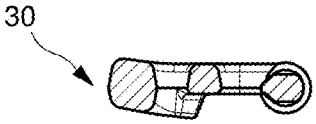
Figure 18A:
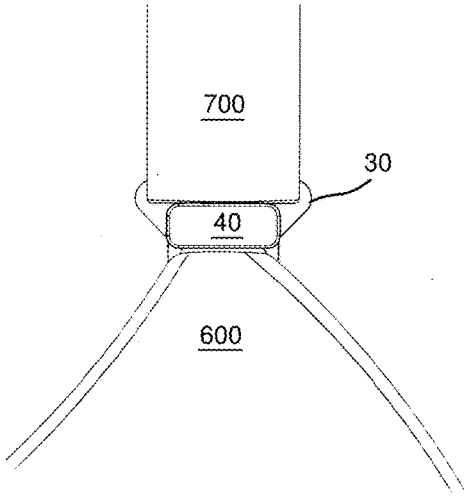
FIGS. 18A-E are partial front elevation views of the elements of a garment system including differently shaped or sized male closure members.
Figure 18B:
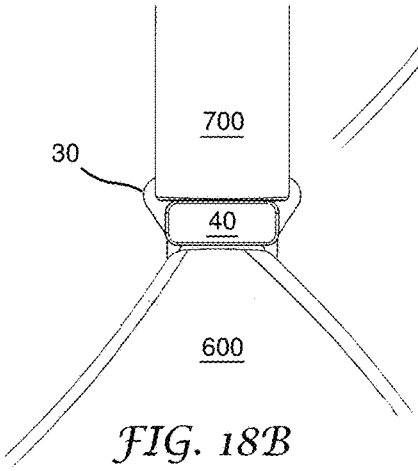
Figure 18C:
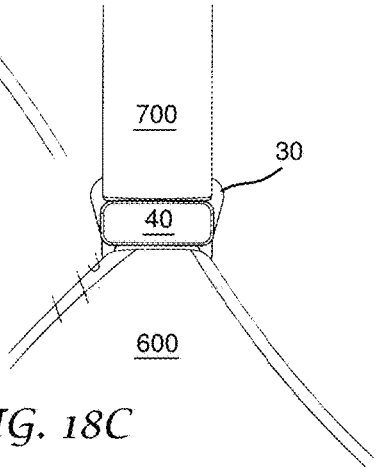
Figure 18D:
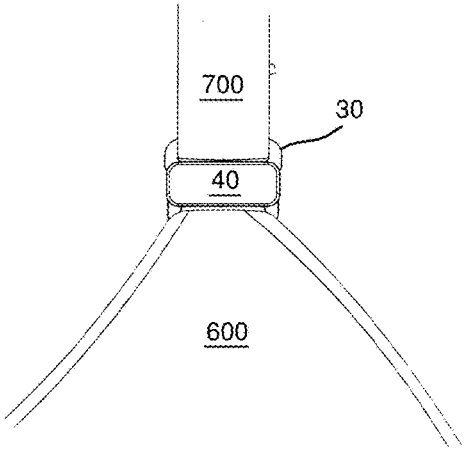
Figure 18E:
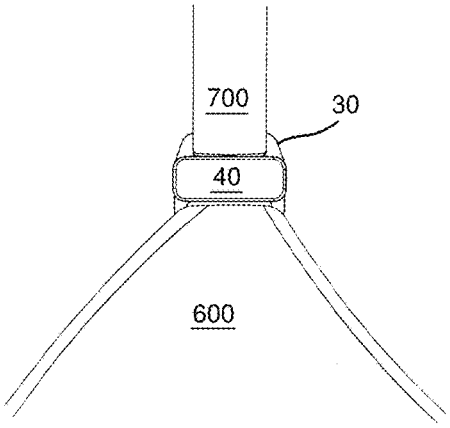

FIGS. 14A and 14B are cross-sectional views of male member 30 and female member 40 in partially coupled states. Cross-sections of members 30 and 40 are as shown in FIGS. 8A and 12. To couple male and female members 30 and 40, the members are oriented such that planes M and F are substantially transverse and bar 32 of the male is aligned with trough 42 of the female. Bar 32 is inserted into trough 42, and one or both of the closure members are rotated until planes M and F are substantially coplanar; ends 510 and 520 of garment 500 are thereby connected. When closure 20 is fully closed, flat rear surface 44 of female member 40 contacts flat front surface 34 of male member 30 (see also FIG. 17D). Flat rear surface 44 of female member 40 allows female member 40 to be coupled with male members 30 of various sizes and shapes, as long as bar 32 and trough 42 are complementary shaped. The contacting flat surfaces 34 and 44 also enables a thin overall closure, with the complete assembly thickness substantially equal to the thickness of either the male or female members alone.

In a preferred embodiment, male member 30 will couple with female member 40 when planes M and F are offset from orthogonal by up to about 15 degrees in either direction. In other words, planes M and F do not need to be oriented at an angle of substantially 90 degrees, but coupling will be possible when planes M and F are oriented between about 75 degrees and about 105 degrees relative to one another. This feature is illustrated by the range of angles marked θ in FIG. 14B. A smaller range of angles is also possible (e.g. +/−10 degrees, +/−5 degrees).

Figure 9B:
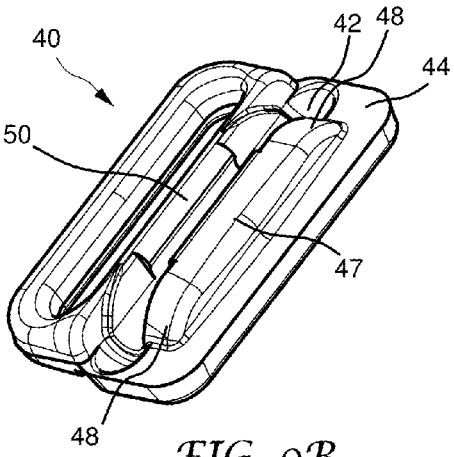
FIG. 9B is a rear perspective view thereof.
Figure 9A:
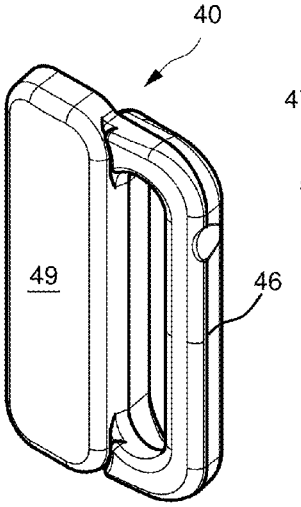
FIG. 9A is a front perspective view of the female member.
Figure 15A:
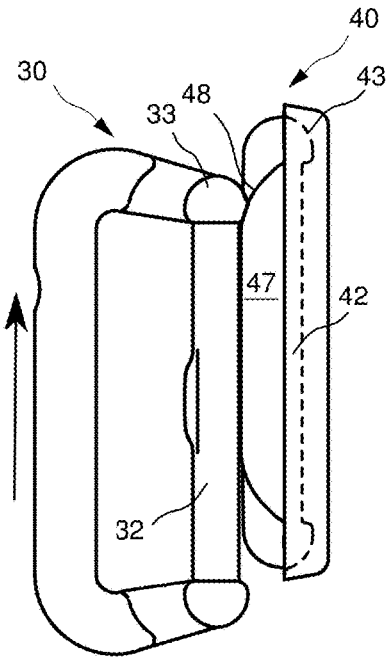
FIGS. 15A-C are side views of the closure in partially coupled positions.
Figure 15B:
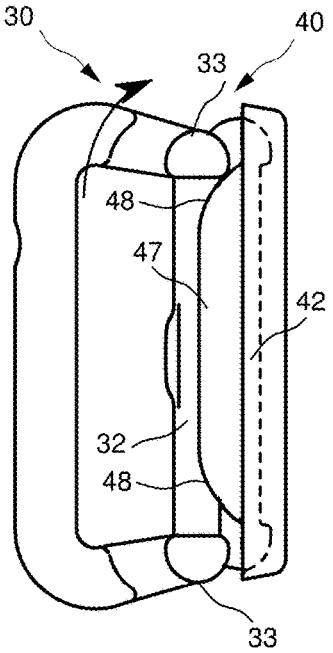
Figure 15C:
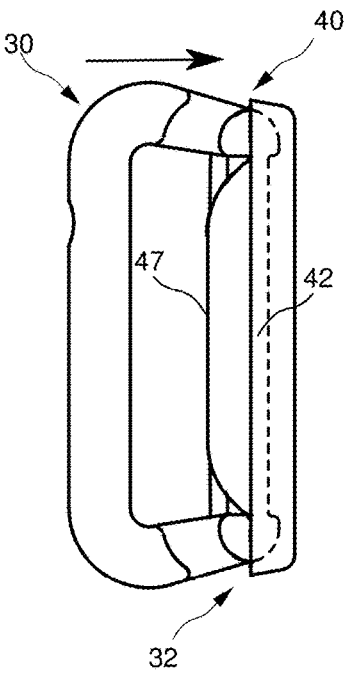
Figure 16A:
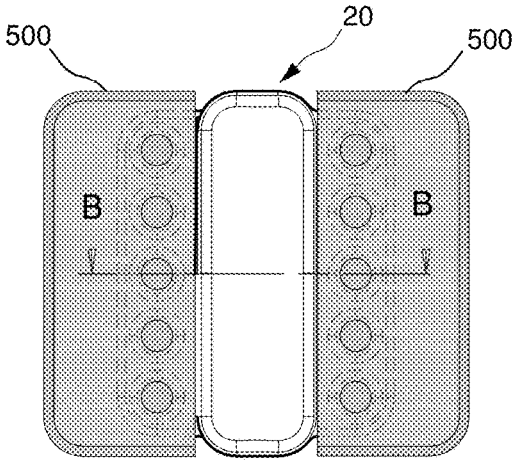
FIG. 16A is a reduced front elevation view of another embodiment of the closure.
Figure 16B:
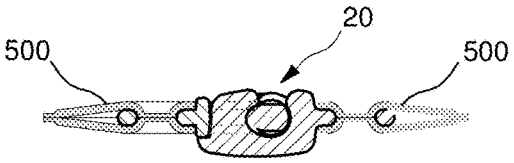
FIG. 16B is a cross-sectional view along the line B-B of FIG. 16A.
Figure 16H:
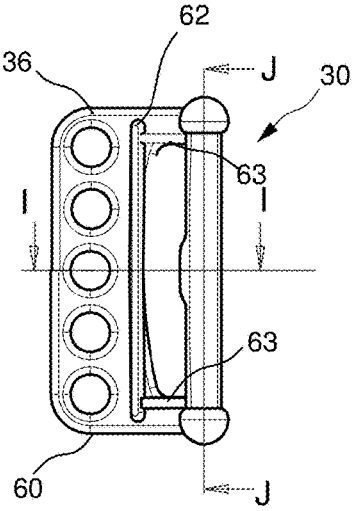
FIG. 16H is a reduced front elevation view of the male member of the closure.
Figure 16J:
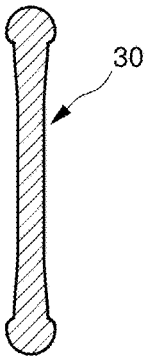
FIGS. 16I-J are, respectively, cross-sectional views along the lines I-I and J-J of FIG. 16H.
Figure 16I:
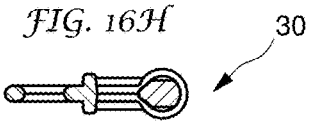
Figure 16D:
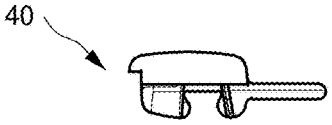
FIGS. 16C-F are reduced front elevation, bottom plan, left side elevation, and rear elevation views, respectively, of the female member of the closure.
Figure 16C:
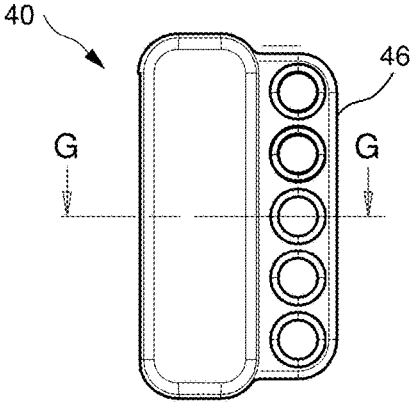
Figure 16E:
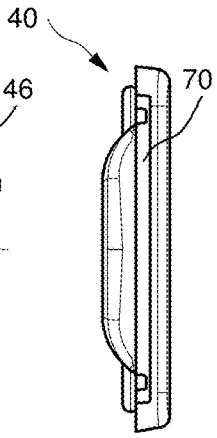
Figure 16F:
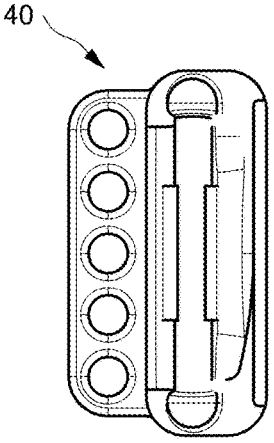
Figure 16G:
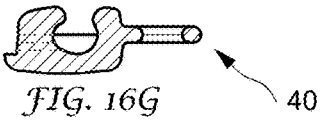
FIG. 16G is a cross-sectional view along the line G-G of FIG. 16C.

In the embodiment of FIGS. 6, 7, and 9B, female trough 42 has two longitudinal sidewalls 47 which extend rearward past flat rear surface 44. One or both of sidewalls 47 do not extend the full length of female member 40 but are somewhat shorter at one or both ends. Sidewalls 47 have tapered or curved ends 48, which curve from the rearmost surface of the sidewall to flat rear surface 44. FIGS. 15A-C are side views of the closure in partially coupled positions. A curved end 48 guides a ball 33 of bar 32 into a concave region 43 of trough 42 (shown in hidden lines in FIGS. 15A-C) in the event that bar 32 and trough 42 are mis-aligned when being coupled. For example, if bar 32 and trough 42 are longitudinally offset (FIG. 15A), one of the members may be shifted longitudinally relative to the other while bar 32 contacts sidewall 47 until ball 33 meets a curved end 48 of sidewall 47. When the longitudinal shift is continued past this point (FIG. 15B), curved end 48 will guide ball 33 toward trough 42 until bar 32 is positioned in trough 42 and members 30 and 40 are coupled (FIG. 15C).

At least one of closure members 30 and 40 includes detent means, such as located on trough 42 or bar 32, for resiliently retaining the closure members in their coplanar positions when coupled. Examples of a detent 50 which locks the two members in their coplanar positions are shown in FIGS. 3 and 7-10. Protrusions, for example thin strips, on sidewalls 47 of trough 42 partially overhand the rearmost access to trough 42, restricting the width of at least a portion of trough 42 (see FIGS. 7, 8A, and 9B). A detent 50 on male member 30 (FIG. 10) is for example a bump which protrudes along the width of at least a portion of bar 32. When closure 20 is closed (FIG. 3), male detent 50 is retained under one or more of female detents 50. The detent resists decoupling of closure 20 by twisting or pulling toward or away from the wearer's body. When the closure is decoupled by rotating male member 30, the male detent may be forcibly passed by the resilient female detent. This action may cause an audible click.

In the embodiment of FIGS. 16A-J, male and female exterior sides 36 and 46 do not include a loop but have a flange 60 for attachment to garment ends by sewing or welding. The preferred method of welding is an ultrasonic weld as described in U.S. Pat. No. 8,186,025 to Fildan, et al. Each closure member may be attached to one or more fabric layers by a similar ultrasonic weld or by simply sewing or the like. Male member 30 includes an alignment bar 62 which aligns with the fabric when welding. Male member 30 also includes one or more reinforcement bars 63 to provide strength and resist bending. Female member 40 includes recesses 70 complementary to male alignment bar 62 and reinforcement bar 63.

These combined features enable this closure to be the thinnest available on the market. In an embodiment, closure 20 has an overall thickness of about 3.2 mm, compared to prior art closures which are about 4.5 mm thick (see U.S. Pat. No. 6,009,604). The thickness of the closure end (male or female exterior side with garment attached) is 3 mm in the loop embodiment and 2.1 mm in the welding flange embodiment. The closure itself is therefore comparable in thickness to the ends where it is joined to the fabric, enabling an extremely flat garment assembly. The present closure is also more narrow between garment ends than comparable prior art closures, due the flat front and rear surfaces 34 and 44.

FIGS. 17A-G are views of another embodiment of closure 20, wherein male and female exterior sides 36 and 46 are differently sized and shaped. This embodiment is one example of how a variety of differently shaped male members 30 may be coupled with female member 40.

Further provided is a garment system comprising a primary garment piece including one of a male or female member 30 or 40 of closure 20, and a plurality of secondary garment pieces 700 each including the other of a male or female member 30 or 40 of closure 20. FIGS. 18A-E show the garment system where a female member 40 of closure 20 is attached to a brassiere cup (primary garment piece 600). The secondary garment piece 700 is a shoulder strap. The shoulder straps shown in each of FIGS. 17A-E include differently shaped or sized male closure members 30, which interchangeably attach to the same female member 40. In this manner, a variety of shoulder straps are readily exchanged on a single brassiere. For example, wide, comfortable straps may be worn during the day, then removed and replaced with small, elegant straps or transparent straps in the evening.

Further provided is a garment including one or more of the described closure.

The embodiments of the thin garment closure described herein are exemplary and numerous modifications, combinations, variations, and rearrangements can be readily envisioned to achieve an equivalent result, all of which are intended to be embraced within the scope of the appended claims. Further, nothing in the above-provided discussions of the closure should be construed as limiting the invention to a particular embodiment or combination of embodiments. The scope of the invention is defined by the appended claims.

We claim:

1. A closure for a garment having a first end and a second end, the closure comprising:

a male member having a male exterior side connected to the first end of the garment, a bar offset from the male exterior side, the bar having two ends and a ball on at least one of the ends, and a flat front surface between the male exterior side and the bar;

a female member having a female exterior side connected to the second end of the garment, a trough shaped complementary to the bar and offset from the female exterior side, a detent at least partially spanning the length of the trough, and a flat rear surface at least partially surrounding the trough;

the bar positionable in the trough when the male member and the female member are in a substantially transverse orientation; and, when the bar is positioned in the trough and the male member is rotated so that the male member and the female member are substantially coplanar, the flat front surface of the male member contacts the flat rear surface of the female member and the first and second ends of the garment are connected.

2. The closure according to claim 1, wherein the bar of the male member has a ball on both ends.

3. The closure according to claim 1, wherein the trough of the female member is open on both ends.

4. The closure according to claim 1, further including:

the trough of the female member having sidewalls projecting rearward along a portion of the length of the trough, the sidewalls having curved ends; and, when the bar and the trough are offset longitudinally and the bar is longitudinally shifted while contacting the sidewalls, the curved ends guiding the ball of the bar into position in the trough.

5. The closure according to claim 4, wherein the detent of the female member is a protrusion on the sidewall of the trough which restricts the width of at least a portion of the trough.

6. The closure according to claim 1, wherein the male member has a male detent which protrudes along the width of at least a portion of the bar.

7. The closure according to claim 1, wherein the male member has a substantially rectangular cross-section.

8. The closure according to claim 1 having a tensile strength of between about 20 pounds and about 30 pounds.

9. The closure according to claim 1, wherein the bar is positionable in the trough when the male member and the female member are oriented at an angle of between about 75 degrees and about 105 degrees.

10. A garment having a first end, a second end, and a closure for connecting the first and second ends, the closure comprising:

a male member having a male exterior side connected to the first end of the garment, a bar offset from the male exterior side, the bar having two ends and a ball on at least one end, and a flat front surface between the male exterior side and the bar;

a female member having a female exterior side connected to the second end of the garment, a trough shaped complementary to the bar and offset from the female exterior side, a detent at least partially spanning the length of the trough, and a flat rear surface at least partially surrounding the trough;

the bar positionable in the trough when the male member and the female member are in a substantially transverse orientation; and, when the bar is positioned in the trough and the male member is rotated so that the male member and the female member are substantially coplanar, the flat front surface of the male member contacts the flat rear surface of the female member and the first and second ends of the garment are connected.

11. The garment according to claim 10, wherein the bar of the male member has a ball on both ends.

12. The garment according to claim 10, wherein the trough of the female member is open on both ends.

13. The garment according to claim 10, further including:

the trough of the female member having sidewalls projecting rearward along a portion of the length of the trough, the sidewalls having curved ends; and, when the bar and the trough are offset longitudinally and the bar is longitudinally shifted while contacting the sidewalls, the curved ends guiding the ball of the bar into position in the trough.

14. The garment according to claim 13, wherein the detent of the female member is a protrusion on the sidewall of the trough which restricts the width of at least a portion of the trough.

15. The garment according to claim 10, wherein the male member has a male detent which protrudes along the width of at least a portion of the bar.

16. The garment according to claim 10, wherein the male member has a substantially rectangular cross-section.

17. The garment according to claim 10 wherein the closure has a tensile strength of between about 20 pounds and about 30 pounds.

18. The garment according to claim 10, wherein the bar is positionable in the trough when the male member and the female member are oriented at an angle of between about 75 degrees and about 105 degrees.

19. A garment system comprising:

a primary garment piece having a primary end;

a plurality of secondary garment pieces each having a secondary end;

a male closure member having a male exterior side, a bar offset from the male exterior side, the bar having two ends and a ball on at least one end, and a flat front surface between the male exterior side and the bar;

a female closure member having a female exterior side connected to the primary end, a trough shaped complementary to the bar and offset from the female exterior side, a detent at least partially spanning the length of the trough, and a flat rear surface at least partially surrounding the trough;

one of the male closure member and the female closure member being a primary closure member connected to the primary end;

the other of the male closure member and the female closure member being a secondary closure member;

one secondary closure member connected to each secondary end;

the bar positionable in the trough when the male closure member and the female member are in a substantially transverse orientation; and, when the bar is positioned in the trough and the male closure member is rotated so that the male closure member and the female closure member are substantially coplanar, the flat front surface of the male closure member contacts the flat rear surface of the female closure member and the primary end and one of the secondary ends are connected.

20. The garment system according to claim 19 wherein each secondary closure member is differently sized or shaped.

* * * * *